US007325914B2

(12) United States Patent
Yamada et al.

(10) Patent No.: US 7,325,914 B2
(45) Date of Patent: Feb. 5, 2008

(54) INK CARTRIDGE AND INK JET PRINTER INCORPORATING THE SAME

(75) Inventors: Koji Yamada, Nagano (JP); Manabu Yamada, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 310 days.

(21) Appl. No.: 11/038,580

(22) Filed: Jan. 21, 2005

(65) Prior Publication Data

US 2005/0174402 A1 Aug. 11, 2005

(30) Foreign Application Priority Data

Jan. 23, 2004 (JP) ..... P2004-015529

(51) Int. Cl.
*B41J 2/175* (2006.01)

(52) U.S. Cl. ..... 347/86; 347/85

(58) Field of Classification Search ..... 347/85, 347/86, 87; 604/256

See application file for complete search history.

(56) References Cited

U.S. PATENT DOCUMENTS

| | | | | |
|---|---|---|---|---|
| 5,633,667 | A | 5/1997 | Miyazawa | |
| 5,777,646 | A | 7/1998 | Barinaga et al. | |
| 5,790,158 | A | 8/1998 | Shinada et al. | |
| 5,907,341 | A | 5/1999 | Miyazawa | |
| 6,145,974 | A | 11/2000 | Shinada et al. | |
| 6,276,785 | B1 | 8/2001 | Shinada et al. | |
| 6,280,024 | B1 | 8/2001 | Miyazawa et al. | |
| 6,361,159 | B1 | 3/2002 | Chino | |
| 6,367,920 | B1 | 4/2002 | Kanai et al. | |
| 6,431,681 | B2 * | 8/2002 | Hatasa et al. | 347/19 |
| 6,474,798 | B1 | 11/2002 | Shinada et al. | |
| 6,502,932 | B1 | 1/2003 | Umemura | |
| 6,554,412 | B1 * | 4/2003 | Seino et al. | 347/86 |
| 6,786,581 | B1 | 9/2004 | Shinada et al. | |
| 6,834,945 | B2 | 12/2004 | Ishizawa et al. | |
| 2002/0060725 | A1 | 5/2002 | Shinada et al. | |
| 2002/0196312 | A1 | 12/2002 | Ishizawa et al. | |
| 2004/0001126 | A1 | 1/2004 | Oda et al. | |
| 2004/0233260 | A1 | 11/2004 | Shinada et al. | |

FOREIGN PATENT DOCUMENTS

| | | |
|---|---|---|
| EP | 1 000 753 A1 | 5/2000 |
| JP | 7-125238 | 5/1995 |
| JP | 2000-94711 | 4/2000 |
| JP | 2000-343725 | 12/2000 |
| JP | 2001-18413 | 1/2001 |

(Continued)

*Primary Examiner*—Anh T. N. Vo
(74) *Attorney, Agent, or Firm*—Nixon & Vanderhye P.C.

(57) ABSTRACT

A cartridge body is formed with a chamber storing ink and a recessed portion having an ink outlet port from which ink in the chamber flows out. An elastic gasket has a first through hole and is fitted into the recessed portion. A gasket stopper has a second through hole and is fitted into the recessed portion such that the gasket is pressed against an inner face of the recessed portion. A hollowed needle having a hole at a tip end thereof is inserted into the ink outlet port while passing through the first through hole and the second through hole and while enlarging the first through hole in order to supply the ink in the chamber to an ink jet recording head via the hole.

13 Claims, 6 Drawing Sheets

FOREIGN PATENT DOCUMENTS

| | | |
|---|---|---|
| JP | 2001-113723 | 4/2001 |
| JP | 2001-191547 | 7/2001 |
| JP | 2002-192739 | 7/2002 |
| JP | 2003-159815 | 6/2003 |
| JP | 2003-311996 | 11/2003 |

* cited by examiner

INK CARTRIDGE AND INK JET PRINTER INCORPORATING THE SAME

BACKGROUND OF THE INVENTION

The present invention relates to an ink cartridge used as an ink supplying source of an ink jet printer. In further detail, the invention relates to an ink cartridge capable of supplying ink with an ink supplying needle at an ink jet printer side inserted into a needle insertion hole formed on a gasket attached to an ink outlet port when the same ink cartridge is mounted in an ink jet printer.

In this type of ink cartridge, for example, as disclosed in Japanese Patent Publication Nos. 2001-113723A and 2002-192739A, an annular projection which protrudes outward from the circumference of a gasket press-fitted to an ink outlet port is formed at the outer circumferential face thereof, and sealing of the gasket is secured. That is, if a gasket is press-fitted to the ink outlet port, the annular projection is forcibly crushed, wherein spacing between the inner circumferential face of the ink outlet port and the outer circumferential face of the gasket is sealed. As a result, air is prevented from invading an ink reservoir in the ink cartridge from outside, passing through the spacing between the outer circumferential face of the gasket and the inner circumferential face of the ink outlet port. Also, air bubbles are prevented from flowing out from the ink reservoir.

The gasket attached to the ink outlet port is formed of a rubber material such as silicone rubber, chloroprene rubber, butyl rubber, etc., or a resilient material such as elastomer resin, etc. These rubber materials and elastomer resin deteriorate over time, and plastic deformation thereof becomes worse. Therefore, the sealing property of a gasket is weakened by chronological deterioration, wherein there is an anxiety that, by a force acting on the gasket when attaching and detaching an ink cartridge, air invades inwardly from outside through spacing between the outer circumferential face of the gasket and the inner circumferential face of the ink outlet port, or air bubbles are flown out from inside to outside. Also, where an ink cartridge is stored or where an ink cartridge remains attached in a printer for a long time period, there is a concern that air gradually invades between the outer circumferential face of the gasket and the inner circumferential face of the ink outlet port, so that air bubbles are deposited at the ink outlet port. Accordingly, air bubbles may be supplied to the ink jet head side of an ink jet printer together with ink, resulting in faulty discharge of ink liquid droplets and an inability to discharge, wherein a deterioration in printing quality results.

SUMMARY OF THE INVENTION

It is therefore an object of the invention to provide an ink cartridge capable of securing an airtight seal between the ink outlet port and a gasket for a long time period.

It is also an object of the invention to provide an ink jet printer incorporating such an ink cartridge as an ink supplying source.

In order to achieve the above objects, according to the invention, there is provided an ink cartridge, comprising:

a cartridge body formed with a first chamber storing ink and a first recessed portion having an ink outlet port from which ink in the first chamber flows out;

an elastic first gasket having a first through hole, and the elastic first gasket being fitted into the first recessed portion; and a first gasket stopper having a second through hole and fitted into the first recessed portion such that the first gasket is pressed against an inner face of the first recessed portion.

With this configuration, spacing between the gasket and the ink outlet port is kept airtight by the gasket stopper. Therefore, in contrast with an assembly where the seal is kept only by the resilient restoration force of the gasket, the seal in this configuration can be kept airtight even if the gasket chronologically deteriorates, wherein it is possible to prevent air from passing through the spacing. Furthermore, since the gasket stopper is press-fitted directly to the first recessed portion of the cartridge body and retained therein, the gasket stopper is prevented from dropping or falling off while securing the position of the gasket. Accordingly, reliability can be improved.

Preferably, the first gasket stopper has a first face brought into contact with a side portion of the inner face of the first recessed portion and a second face brought into contact with the first gasket so as to press the first gasket against a bottom portion of the inner face of the first recessed portion.

In this case, when press-fitting the gasket stopper into the first recessed portion, it is possible to manage the amount of insertion thereof. Accordingly, it is possible to manage the airtight seal.

Here, it is preferable that the bottom portion of the inner face of the first recessed portion is provided with an annular projection surrounding the ink outlet port.

In this case, the projection is cut into the second face of the gasket, whereby the airtight seal between the gasket and the ink outlet port can be secured.

Preferably, the first gasket has a projection adapted to be fitted with the first gasket stopper.

In this case, the gasket is fitted with the gasket stopper before press-fitting the gasket into the first recessed portion. Accordingly, both members can be simultaneously fitted into the first recessed portion, and the assembling work can be simplified.

Alternatively, it is preferable that the first gasket stopper has a first face brought into contact with a first side portion of the inner face of the first recessed portion and a second face brought into contact with an inner face of the first through hole of the first gasket so as to press the first gasket against a second side portion of the inner face of the first recessed portion.

Here, it is preferable that an annular protrusion is formed on an outer circumferential face of the first gasket and brought into contact with the second side portion of the inner face of the first recessed portion in order to secure the seal between the gasket and the ink outlet port.

Preferably, a first valve body is disposed in the first chamber. Here, a first elastic member urges the first valve body toward the first recessed portion such that the first through hole of the first gasket is closed by the first valve body.

Preferably, the cartridge body is formed with a second chamber storing waste ink and a second recessed portion having an ink inlet port from which the waste ink flows in. The ink cartridge further comprises: an elastic second gasket, having a third through hole and fitted into the second recessed portion; and a second gasket stopper, having a fourth through hole and fitted into the second recessed portion such that the second gasket is pressed against an inner face of the second recessed portion.

With this configuration, it is possible to securely prevent waste ink from leaking through the ink inlet port.

Here, it is preferable that the second gasket stopper has a first face brought into contact with a side portion of the inner face of the second recessed portion and a second face brought into contact with the second gasket so as to press the second gasket against a bottom portion of the inner face of the second recessed portion.

It is further preferable that the bottom portion of the inner face of the second recessed portion is provided with an annular projection surrounding the ink outlet port.

It is also preferable that the second gasket has a projection adapted to be fitted with the second gasket stopper.

Alternatively, it is also preferable that the second gasket stopper has a first face brought into contact with a first side portion of the inner face of the second recessed portion and a second face brought into contact with an inner face of the third through hole of the second gasket so as to press the second gasket against a second side portion of the inner face of the second recessed portion.

Here, it is further preferable that an annular protrusion is formed on an outer circumferential face of the second gasket and brought into contact with the second side portion of the inner face of the second recessed portion.

It is also preferable that a second valve body is disposed in the second chamber. Here, a second elastic member urges the second valve body toward the second recessed portion such that the third through hole of the second gasket is closed by the second valve body.

According to the invention, there is also provided an ink jet printer, comprising:

an ink jet recording head; and a first hollowed needle, having a first hole at a tip end thereof and adapted to be inserted into the ink outlet port of the above ink cartridge while passing through the first through hole and the second through hole and while enlarging the first through hole in order to supply the ink in the first chamber to the ink jet recording head via the first hole.

Preferably, the ink jet printer further comprises a second hollowed needle, having a second hole at a tip end thereof and adapted to be inserted into the ink inlet port of the ink cartridge as set forth in claim 8 while passing through the third through hole and the fourth through hole and while enlarging the third through hole in order to supply the waste ink to the second chamber via the second hole.

With the above configurations, since it is possible to securely prevent air from invading the ink cartridge through the spacing between the ink outlet port and the gasket, air bubbles formed by invaded air are prevented from being supplied to the ink jet recording head along with ink, and faulty discharge and an inability to discharge ink droplets are prevented, thereby maintaining printing quality. In addition, it is possible to securely prevent waste ink from leaking through the ink inlet port.

According to the invention, there is also provided an ink cartridge, comprising:

an ink chamber having a recess portion formed inside a casing and an ink outlet;

an elastic gasket fitted into a bottom of the recess portion;

a movable cover inserted through a top portion of the recess portion, the movable cover dividing an ink reservoir and an atmospheric communication chamber; and a coil spring urging the movable cover toward the ink reservoir, wherein as ink is filled in the ink reservoir, ink invades a gap between the movable cover and an inner face of the recess portion forming an ink meniscus, wherein the gap is sized such that a strength of the ink meniscus is greater than an ink pulling force acting on the ink outlet.

An urging force of the coil spring is preferably less than the strength of the ink meniscus.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE INVENTION

Embodiments of the invention will be described below in detail with reference to the accompanying drawings.

Figure 1:
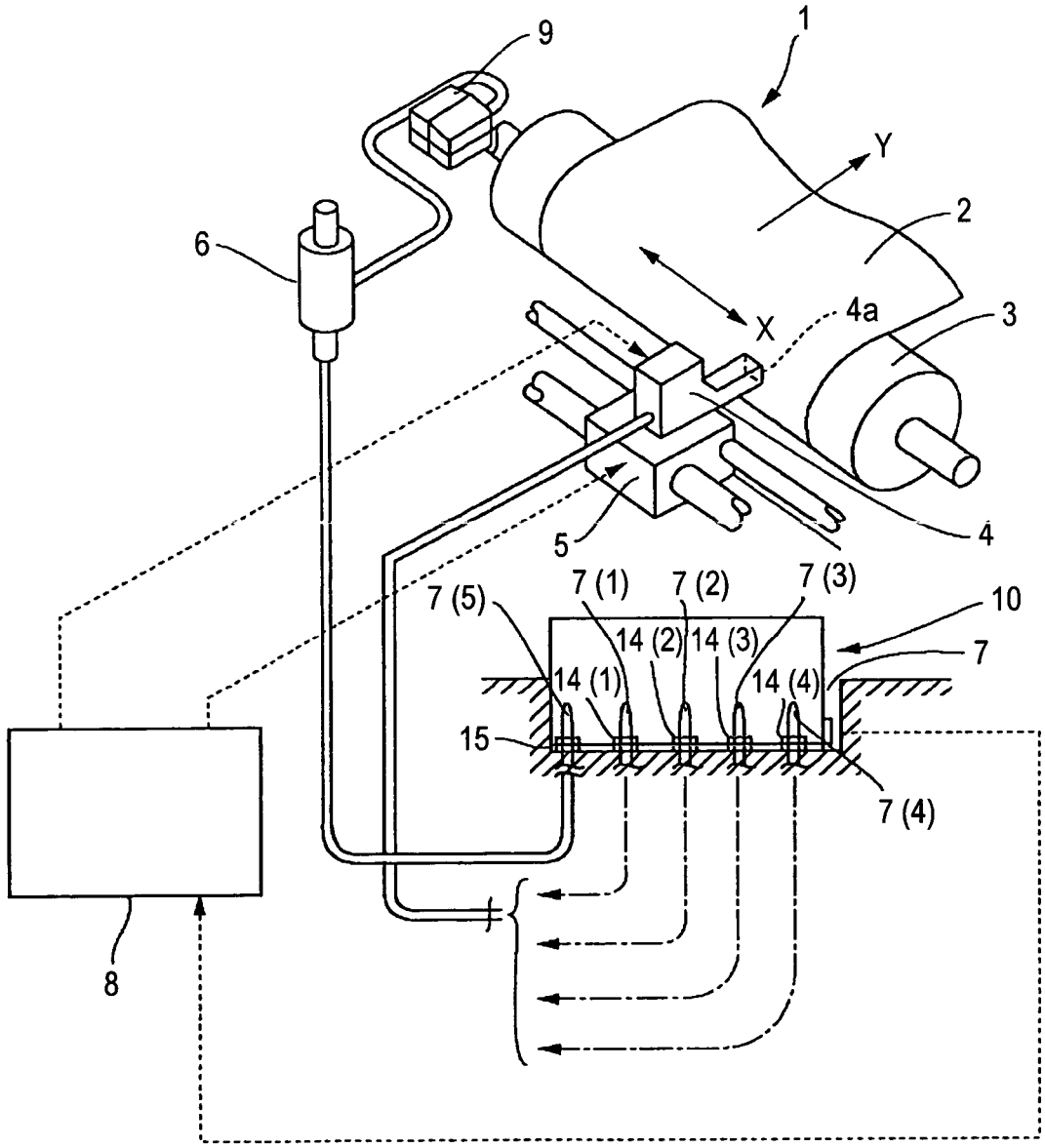
FIG. 1 is a schematic view of an ink jet printer incorporating an ink cartridge according to a first embodiment of the invention.
Figure 2A:
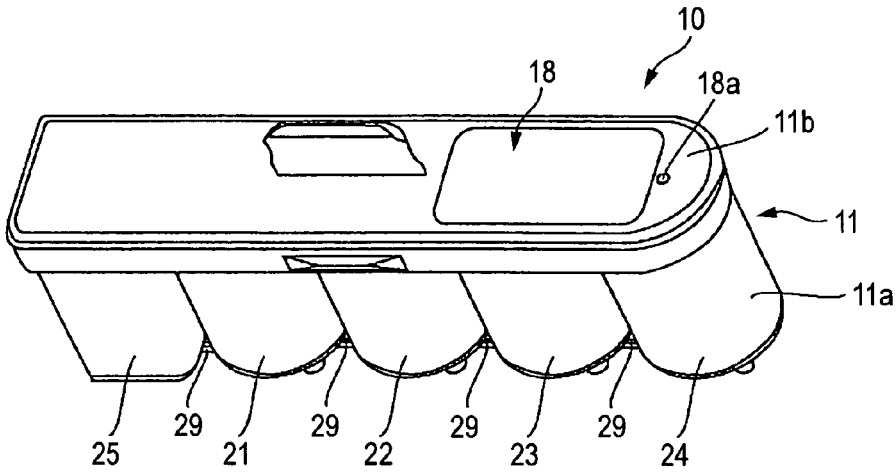
FIG. 2A is an upper perspective view of the ink cartridge.
Figure 2B:
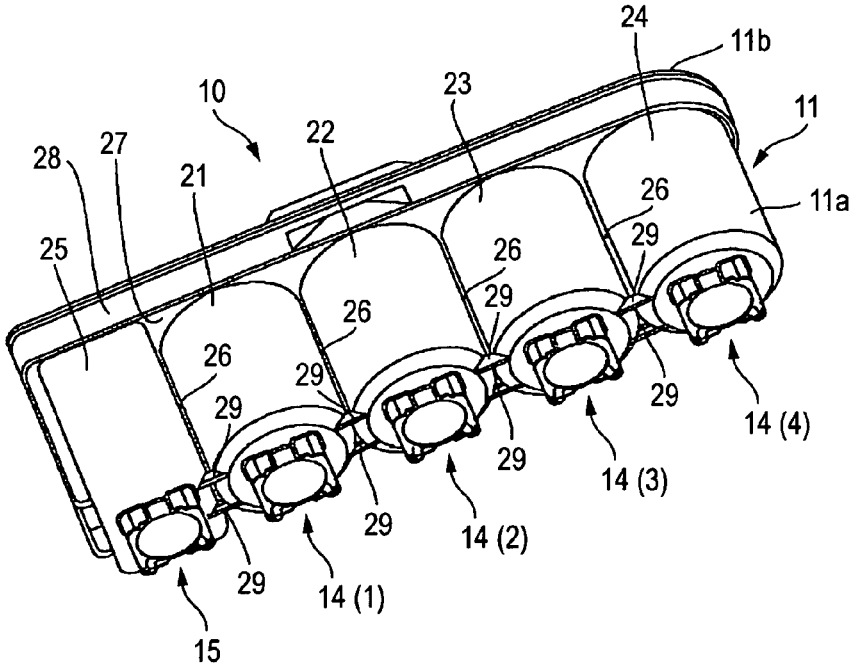
FIG. 2B is a lower perspective view of the ink cartridge.
Figure 3:
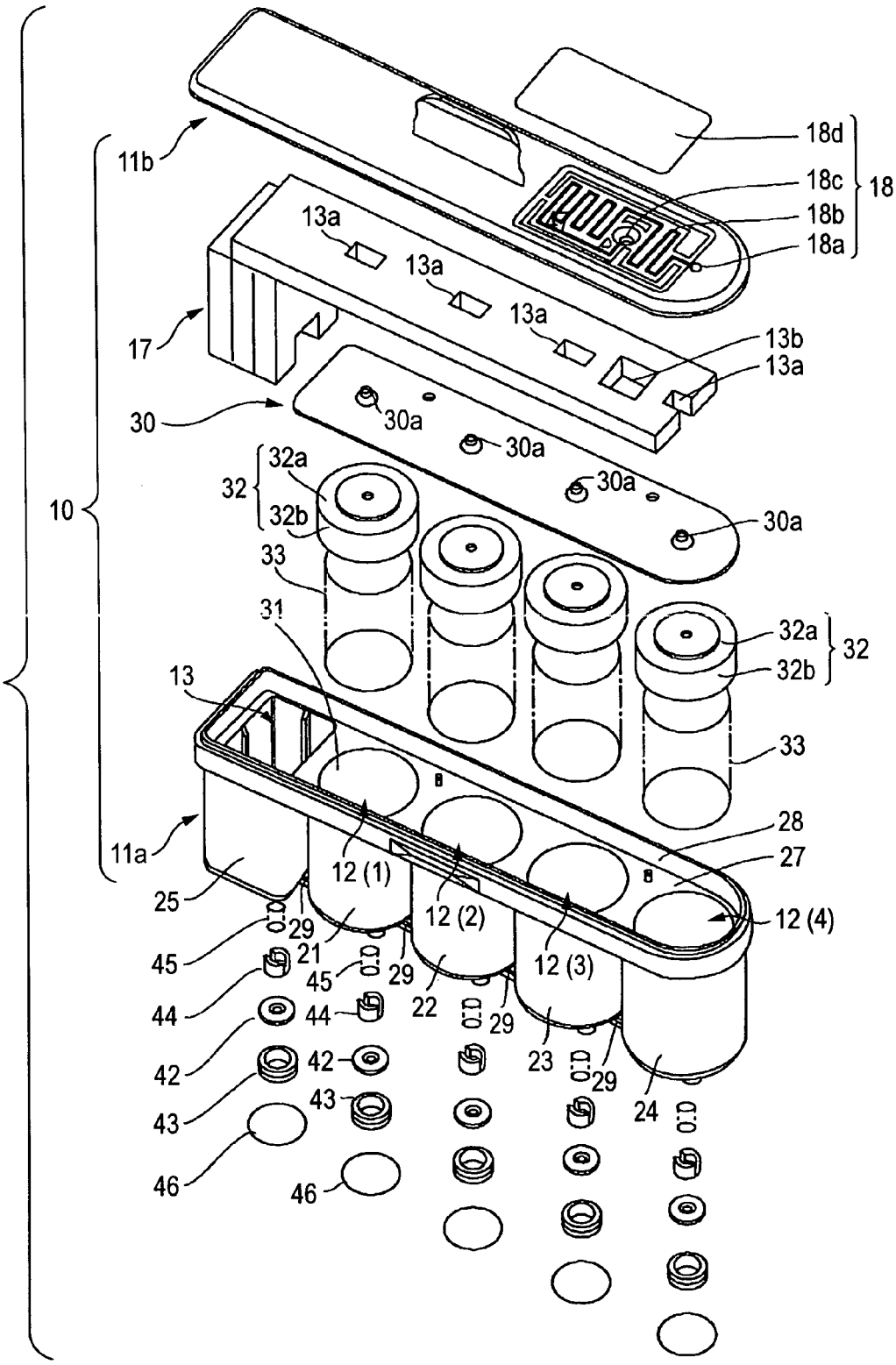
FIG. 3 is a perspective view of a disassembled state of the ink cartridge.

As shown in FIG. 1, an ink jet printer 1 comprises: a platen 3 for transporting a recording medium 2 in a direction indicated by an arrow Y; an ink jet head 4 whose nozzle face 4*a* is opposed to the platen 3; a carriage 5 for causing the ink jet head 4 to reciprocate in directions indicated by arrows X; a cartridge mounting portion 7 capable of mounting an ink cartridge 10 which supplies respective colors of ink to respective ink nozzles of the ink jet head 4, and a controller 8 configured to drive the respective portions in the ink jet printer 1.

The ink cartridge 10 is provided with four independent ink chambers in which black ink, cyan ink, yellow ink and magenta ink are respectively stored, and a waste ink chamber for collecting waste ink. The cartridge mounting portion 7 is provided with ink supplying needles 7(1) through 7(4) for taking out ink from respective chambers, and a waste ink supplying needle 7(5) for supplying waste ink to the waste ink chamber. When the ink cartridge 10 is mounted in the cartridge mounting portion 7, an ink supplying channel is formed, which supplies respective colors of ink from the ink cartridge 10 to the jet head 4.

The ink jet printer 1 includes a nozzle cap 9 at a position deviated from the platen 3 in the printing direction X. The nozzle cap 9 is connected with the waste ink supplying needle 7(5) via an ink pump 6. Therefore, if the ink cartridge 10 is mounted in the cartridge mounting portion 7, a waste ink collecting channel is formed from the nozzle cap 9 to the waste ink chamber in the ink cartridge 10 via the ink supplying needle 7(5). If the ink pump 6 is driven with the nozzle cap 9 covered on the nozzle face 4*a* of the ink jet head 4, it is possible to collect waste ink from the head side into the waste ink chamber.

As shown in FIGS. 2A through 4B, the ink cartridge 10 comprises four ink chambers 12(1) through 12(4) and one waste ink chamber 13 which are formed in a laterally elongated casing 11. The casing 11 is composed of a casing body 11*a* and a cover plate 11*b* for sealing a top opening of the casing body 11*a*. The cover plate 11*b* is thin, and its rear side is almost flat. Ink outlet ports 14(1) through 14(4) of the respective ink chambers 12(1) through 12(4) and a waste ink inlet port 15 for collecting waste ink into the waste ink chamber 13 are formed on the bottom of the casing body 11*a*.

The casing body 11*a* is provided with cylindrical casings 21 through 25 which are laterally arrayed and top ends thereof are open. Each adjacent casings are connected by a thin vertical plate 26. The upper end portions of the casings 21 through 25 are connected to a lateral connection plate 27. A circumferential frame 28 is formed at the outer circumferential edge of the lateral connection plate 27 so as to have a predetermined height. The bottom portions of the cylindrical casings 21 through 25 are connected to each other by a lateral connection plate 29. The casing body 11*a* is an article molded with plastic injection.

The four ink chambers 12(1) through 12(4) each having a circular cross section and an open top end are formed with the cylindrical casings 21 through 24. The open top ends of the respective ink chambers 12(1) through 12(4) are blocked by a partitioning plate 30 made of a material such as plastic, which is mounted inside the circumferential frame 28 of the lateral connection plate 27. Cylindrical atmospheric communication ports 30*a* passing through the partitioning plate 30 in its thickness direction are formed at points corresponding to the respective ink chambers 12(1) through 12(4). The open top ends of the outer circumferential plate portion 28 of the casing body 11*a* are blocked by a cover plate 11*b*, and a slender space extending in the lateral direction is formed between the partitioning plate 30 and the cover plate 11*b*. An L-shaped space extending from the above-described space to the space in the casing 25 is formed to constitute the waste ink chamber 13. The waste ink chamber 13 is filled with an ink absorbing body 17 such as a foam or felt material.

An atmospheric communication port 18 for communicating the waste ink chamber 13 to the atmosphere is formed at the end portion opposite to the end portion opposed to the casing 25 in the cover plate 11*b*. The atmospheric communication port 18 is provided with: a recess portion 18*a* having a circular cross section and formed on the outer face of the cover plate 11*b*; a groove 18*b* formed on the outer face of the cover plate 11*b*; a through hole 18*c* piercing through the cover plate 11*b* and communicating with the waste ink chamber 13; and a sealing film 18*d*. One end portion of the groove 18*b* communicates with the recess portion 18*a* and the other end portion thereof communicates with the through hole 18*c*. The sealing film 18*d* is adhered to the outer face of the cover plate 11*b* so as to seal the through hole 18*c* and the groove 18*b* airtight, so that only the recess portion 18*a* is exposed at the outer face of the cover plate 11*b*.

In the waste ink chamber 13, empty portions 13*a* having a rectangular cross section and having no ink absorbing body 17 filled therein, are formed at parts where the atmospheric communication ports 30*a* are provided in the partitioning plate 30. Thereby, the atmospheric communication ports 30*a* are isolated from the ink absorbing body 17 by the corresponding empty portions 13*a*. Similarly, an empty portion 13*b* having a rectangular cross section and having no ink absorbing body 17 filled therein is formed at a portion where the through hole 18*c* of the cover plate 11*b* is provided, wherein the through hole 18*c* is isolated from the ink absorbing body 17.

Next, a description follows of the structures of the ink chambers 12(1) through 12(4). Respective colors of ink, cyan, magenta, yellow and black, are filled in the ink chambers 12(1) through 12(4). The structures of the respective ink chambers 12(1) through 12(4) are identical to each other. Therefore, a description follows of the structure of only the ink chamber 12(1), and repetitive description of the other ink chambers 12(2) through 12(4) will be omitted.

The ink chamber 12(1) is provided with: a circular recess portion 31 formed inside the cylindrical casing 21; an ink outlet port 14(1) formed at the center portion of the bottom face of the circular recess portion 31; a movable cover 32 inserted through the open portion (i.e., a top open portion of the circular recess portion 31) of the ink chamber 12(1); and a coil spring 33 for urging the movable cover 32 upwards. The movable cover 32 partitions the underside ink reservoir 34, at which the ink outlet port 14(1) is provided, from the atmospheric communication chamber 35 communicating with the waste ink chamber 13 via the atmospheric communication port 30*a*. The movable cover 32 is made reciprocal in the vertical direction along the inner circumferential face 31*a* of the circular recess portion 31. The movable cover 32 is provided with a disk-shaped main body 32*a* and a cylindrical portion 32*b* extending downward from the outer circumferential face of the main body 32*a*.

As ink is filled in the ink reservoir 34, ink invades a gap 36 between the movable cover 32 and the inner circumferential face of the circular recess portion 31, thereby forming an ink meniscus. By setting the gap 36 to an adequate dimension, the strength of the ink meniscus formed in the corresponding gap 36 is made larger than an ink pulling force acting on the ink outlet port 14(1), whereby the ink meniscus is prevented from being broken when the ink pulling operation is performed. In the present embodiment, for example, the cylindrical portion 32*b* of the movable cover 32 is formed so that the outer dimension thereof is made smaller by approximately 0.1 mm than the inner dimension of the inner circumferential face 31*a* of the circular recess portion 31. Therefore, as the movable cover 32 is inserted to be concentric with the circular recess portion 31, a gap 36 which is 0.05 mm wide is formed to become annular therebetween.

Since the inside of the ink reservoir 34 is maintained at a predetermined negative pressure at all times by the coil spring 33 urging the movable cover 32 upward, ink is prevented from leaking outside from the ink reservoir 34 via the ink outlet port 14(1) in a state where no ink pulling force acts on the ink outlet port 14(1). Further, even if the ink cartridge 10 is inclined sideways or is turned upside down, no ink leaks from the gap 36 between the inner circumferential face 31*a* of the circular recess portion 31 and the movable cover 32 toward the atmospheric communication chamber 35 communicating with the waste ink chamber 13.

The urging force of the coil spring 33 is set so as to become smaller than the strength of the ink meniscus and the ink pulling force acting on the ink outlet port 14(1). Therefore, the ink meniscus is prevented from being broken by the urging force of the coil spring 33, and air bubbles are prevented from invading the ink reservoir 34. Also, as ink is sucked from the ink outlet port 14(1), the movable cover 32 moves toward the ink outlet port 14(1) in response to the ink suction force.

Figure 5A:
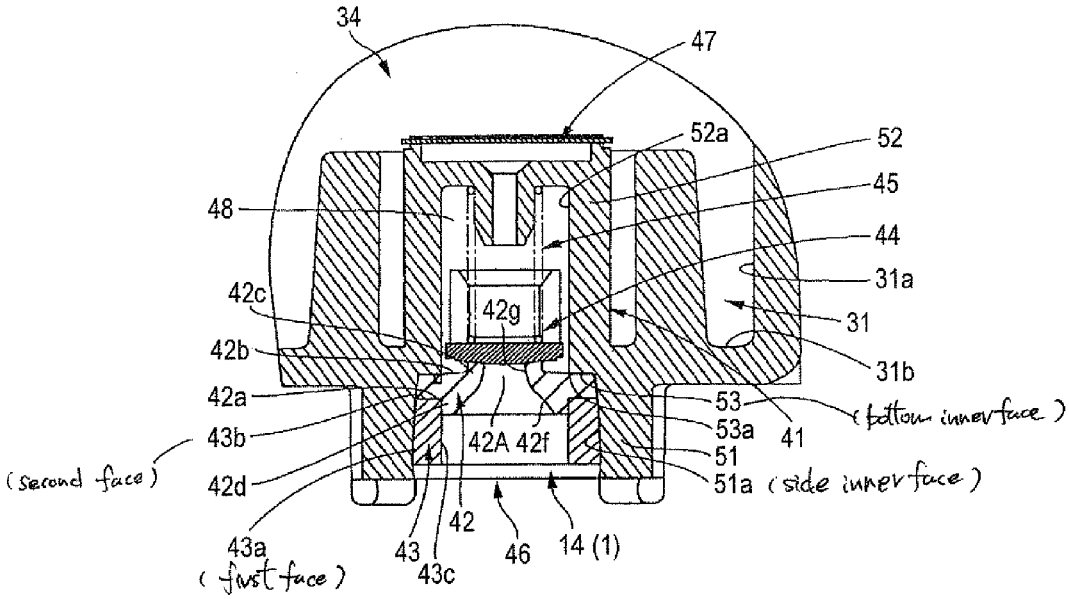
FIG. 5A is an enlarged section view of an ink outlet port in the ink cartridge, showing a state that an ink supplying needle is not inserted into the ink outlet port.
Figure 5B:
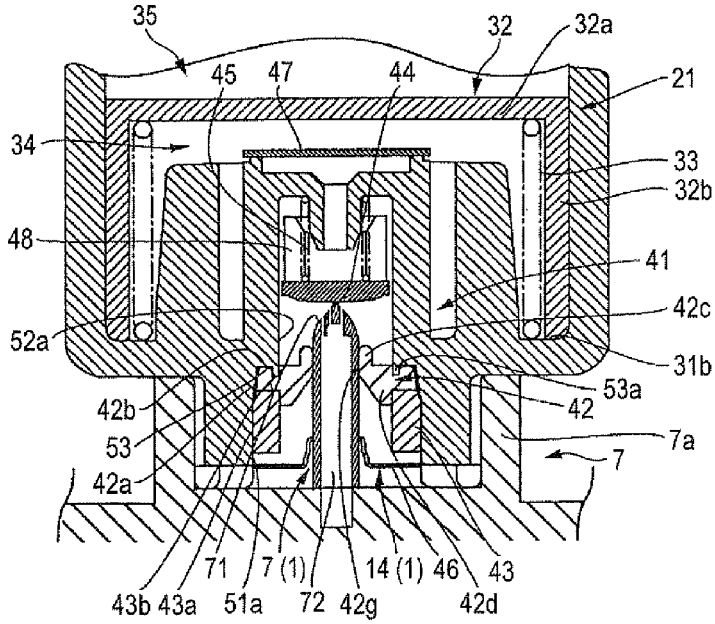
FIG. 5B is an enlarged section view of the ink outlet port, showing a state that an ink supplying needle is inserted into the ink outlet port.

With reference to FIGS. 5A and 5B, a description follows of the airtight structure of the ink outlet port 14(1). Since the airtight structures of the other ink outlet ports 14(2) through 14(4) and the waste ink inlet port 15 are the same as that of the ink outlet port 14(1), repetitive explanations for those will be omitted.

A cylindrical portion 41 is formed at the center of the bottom face of the ink reservoir 34, which passes through and extends from the bottom plate portion 31*b* of the circular recess portion 31, and the ink outlet port 14(1) is defined by the cylindrical portion 41. A gasket 42 having an insertion hole 42A (described later in detail) formed at the center thereof is mounted in the ink outlet port 14(1). The gasket 42 is pressed to the ink outlet port side by a gasket stopper 43 from the outside. A valve body 44 is urged from the inside to the gasket 42 by a coil spring 45 at all times, so that the insertion hole 42A is closed by the valve body 44. The outside opening (the lower end opening) of the ink outlet port 14(1) is sealed by a plastic film 46, and a filter 47 for eliminating foreign substances is attached to the inside opening (upper end opening) of the ink outlet port 14(1).

A rectangular positioning frame 7*a* into which the ink outlet port 14(1) can be inserted is formed at the cartridge mounting portion 7 at the ink jet printer 1 side. The ink supplying needle 7(1) protrudes upwards from the center of the rectangular frame 7*a*. A plurality of ink orifices 71 are formed at a tip end portion of the ink supplying needle 7(1), and an ink passage 72 is formed inside of the ink supplying needle 7(1).

As the ink cartridge 10 is mounted at the cartridge mounting portion 7, the ink supplying needle 7(1) breaks through the plastic film 46 and is inserted into the insertion hole 42A with the gasket 42 widened, thereby pushing up the valve body 44. As a result, an ink supplying channel is formed from the ink reservoir 34 to the nozzle orifices of the ink jet head 4 in the ink jet printer 1 via the ink supplying needle 7(1). If the ink cartridge 10 is removed from the cartridge mounting portion 7, the valve body 44 is again returned by the pressing force of the coil spring 45 to a state where the valve body 44 is abutted against the gasket 42, so that the ink outlet port 14(1) is returned to a closed state.

The lower half portion of the cylindrical portion 41 which forms the ink outlet port 14(1) is made into an outer cylindrical portion 51 provided with a circular inner circumferential face 51*a* having a first diameter, and the upper half portion thereof is made into an inner cylindrical portion 52 provided with a circular inner circumferential face 52*a* having a second diameter which is smaller than the first diameter. Therefore, an annular end face 53 is formed at the boundary between the inner circumferential face 51*a* and the inner circumferential face 52*a*. An annular projection portion 53*a* is formed along the inner circumferential edge portion on the annular end face 53. The gasket 42 and the gasket stopper 43 are provided in the outer cylindrical portion 51, and the valve body 44 and coil spring 45 are provided in the inner cylindrical portion 52.

The gasket 42 is formed of a rubber material such as silicone rubber, chloroprene rubber, butyl rubber, etc., or a resilient material such as an elastomer material, and presents an annular shape provided with an outer circumferential face 42*a* brought into contact with the inner circumferential face 51 a of the outer cylindrical portion 51. An annular end face 42*b* is continued to the ink reservoir side end of the outer circumferential face 42*a*, and an annular valve seat portion 42*c* protruding into the inner cylindrical portion 52 is formed at the inner circumferential edge portion of the annular end face 42*b*. The valve body 44 is seated in the annular valve seat portion 42*c*. An annular fitting projection 42*d* formed on the other annular end face of the gasket 42. The inner circumferential face that defines the insertion hole 42A at the center of the gasket 42 is provided with: a guide face 42*f* for the ink supplying needle, which is widened toward the outside of the insertion hole 42A; and a circular inner circumferential face 42*g* which is widened by the ink supplying needle 7(1) and is brought into contact with the outer circumferential face thereof in a liquid-tight state.

The gasket stopper 43 is made of a plastic rigid component and is provided with an outer circumferential face 43*a* which can be inserted into the inner circumferential face 51*a* of the cylindrical portion 41 which defines the ink outlet port 14(1). An annular end face 43*b* continued to the ink reservoir side end of the outer circumferential face 43*a* has such a size corresponding to the annular end face 53 at the ink outlet port side. Further, the fitting projection 42*d* of the gasket 42 can be fitted to an inner circumferential face 43*c* of the gasket stopper 43.

The gasket 42 is mounted in a state where it is pressed to the annular end face 53 at the ink outlet port side by the annular end face 43*b* of the gasket stopper 43. Also, since the annular projection 53*a* is formed at the annular end face 53, the annular end face 42*b* of the gasket 42 is pressed to the annular end face 53 in a state where the annular projection portion 53*a* is cut into the annular end face 42*b*. In other words, the annular end face 42*b* of the gasket 42 is forcibly pressed by the gasket stopper 43 against the annular end face 53 formed with the annular projection portion 53*a*. Therefore, even if the gasket 42 deteriorates through a long period of use and is plastically deformed, the airtight seal between the gasket 42 and the ink outlet port 14(1) is prevented from being reduced, and air is prevented from invading a small ink chamber 48 formed between the filter 47 and the valve body 44. In addition, when attaching and detaching the ink cartridge 1, air is prevented from invading the small ink chamber 48 from outside through the gasket 42 and the ink outlet port 14(1) by a force acting on the gasket 42, and air bubbles are prevented from flowing out from the small ink chamber 48 to the outside.

Since the fitting projection 42*d* which can be fitted into the gasket stopper 43 is formed at the annular end face of the gasket 42, it is possible to simultaneously press-fit both the components 42 and 43 into the insertion hole 42A after the gasket 42 is fitted into the end of the gasket stopper 43. Accordingly, the assembly can be simplified in comparison with a case where the respective components are separately press-fitted into the insertion hole 42A.

Therefore, in the ink jet printer 1 employing the above described ink cartridge 10 as an ink supplying source, invasion of air into the ink jet head side due to an insufficient seal between the gasket and the ink outlet port is prevented, so that an inability of ejection or faulty ejection of ink droplets can be avoided. Accordingly, printing quality can be maintained.

Figure 4A:
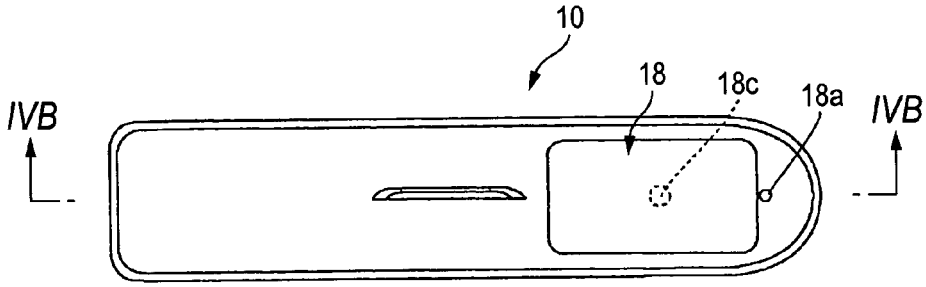
FIG. 4A is a top plan view of the ink cartridge.
Figure 4B:
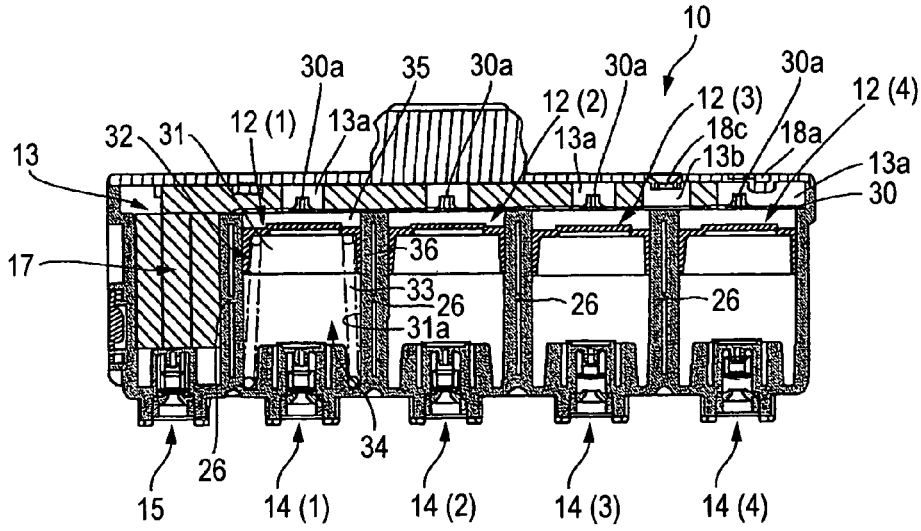
FIG. 4B is a section view taken along a line IVB-IVB in FIG. 4A.

In a state where ink is filled in the ink reservoir 34 of the ink chamber 12(1), as shown in FIG. 4B, the movable cover 32 is positioned in the vicinity of the upper end position of the circular recess portion 31, so that the capacity of the atmospheric communication chamber 35 is minimized.

Since an ink meniscus is formed in the gap 36 between the movable cover 32 and the inner circumferential face 31*a* of the circular recess portion 31, the atmospheric communication chamber 35 communicating with the waste ink chamber 13 and the ink reservoir 34 are isolated from each other by the movable cover 32. Further, since the movable cover 32 is pushed up by the coil spring 33 toward the atmospheric communication chamber 35, the inside of the ink reservoir 34 is kept in a predetermined negative pressure state.

As an ink pulling force brought by the ink jet head 4 side acts on the ink outlet port 14(1), the movable cover 32 moves to the ink outlet port 14(1) side against the urging force of the coil spring 33, whereby a predetermined quantity of ink is supplied from the ink outlet port 14(1) to the ink jet head 4.

Since the strength of the ink meniscus formed in the gap 36 between the moving movable cover 32 and the inner circumferential face 31*a* of the circular recess portion 31 is larger than the ink pulling force, the ink meniscus is not broken by the ink pulling force. Therefore, air bubbles are prevented from invading the ink reservoir 34 side from the atmospheric communication chamber 35 side through the gap 36. Additionally, no ink leaks from the ink reservoir 34 side to the atmospheric communication chamber 35 side via the gap 36.

Thus, the inside of the ink reservoir 34 is kept in an adequate negative pressure state, wherein ink can be supplied without mixture of air bubbles therewith and leakage of ink. In the ink end state, as shown in FIG. 5B, the movable cover 32 falls to the position where it is brought into contact with the bottom face of the circular recess portion 31, and the capacity of the ink reservoir 34 is minimized.

Figure 6:
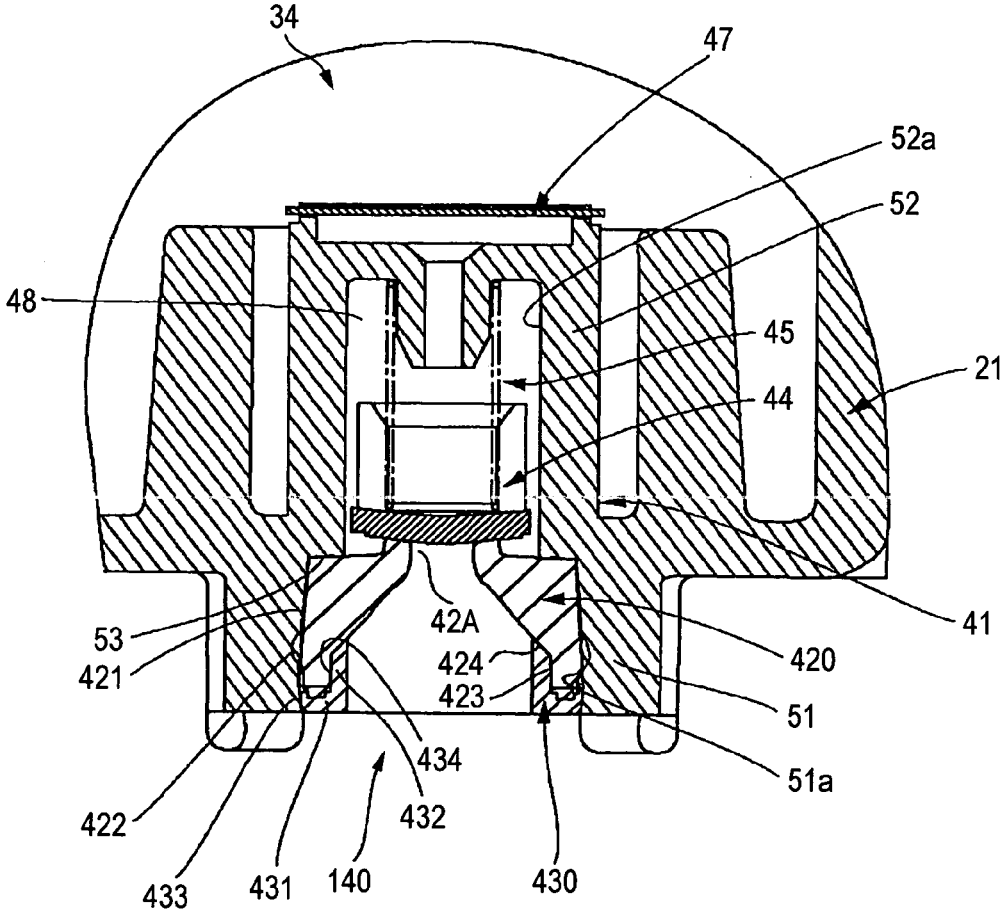
FIG. 6 is an enlarged section view of an ink outlet port in an ink cartridge according to a second embodiment of the invention.

FIG. 6 shows a second embodiment of the invention. The basic configuration of the airtight structure according to the present embodiment is identical to that in the first embodiment. The corresponding parts are given the same reference numerals, and a repetitive description for those will be omitted.

The airtight structure of the ink outlet port according to this embodiment is composed of a gasket 420, which is press-fitted into the ink outlet port 140, and a gasket stopper 430. The ink outlet port 140 is basically identical to the ink outlet port 14(1) shown in FIGS. 5A and 5B. However, the annular end face 53 is made into a flat face, and is not provided with the annular projection portion 53*a*. The gasket 420 is provided with an insertion hole 42A at the center thereof, and the outer circumferential portion 421 is press-fitted into the inner circumferential face 51*a* of the ink outlet port 140. An annular protrusion 422 is formed on the outer circumferential portion 421. The gasket stopper 430 is made annular as a whole, and is shaped so as to have an L-shaped cross section in which a cylindrical portion 432 extends upwards from the inner circumferential edge portion of an annular bottom plate portion 431.

An outer circumferential face 433 of the annular bottom plate portion 431 is press-fitted into the circular inner circumferential face 51*a* of the ink outlet port 140. An outer circumferential face 434 of the cylindrical portion 432 is fitted into the inner circumferential face 423, which defines the insertion hole 42A of the gasket 420, and a tapered needle guide face 424 is continued from the inner circumferential face 423. Also, the outer circumferential face 434 of the cylindrical portion 432 confronts the annular protrusion 422 of the gasket 420 in a press-fitted state.

As the gasket 420 is press-fitted into the ink outlet port 140, the outer circumferential face 421 of the gasket 420 is brought into contact with the inner circumferential face 51*a* in a state where the annular protrusion 422 is crushed. If the gasket stopper 430 is press-fitted into the ink outlet port 140, the outer circumferential face 434 of the cylindrical portion 432 is fitted inside the gasket 420 where the gasket 420 is forcibly pushed to the inner cylindrical face 51*a*.

Therefore, in the present embodiment, the outer circumferential face 421, at which the annular protrusion 422 is formed, in the gasket mounted on the ink outlet port 140 is pushed to the inner circumferential face 51*a* at the ink outlet port side by the gasket stopper 430, and an airtight seal is secured between the outer circumferential face 421 and the inner circumferential face 51*a*. Therefore, even if the gasket 420 deteriorates through a long time period of use and a force operates on the gasket 420 when attaching and detaching an ink cartridge 10, the airtight seal can be maintained therebetween.

In addition, the invention is not limited to the above-described embodiments. It may be subjected to various modifications. For example, although, in the embodiments, a description was given of the ink outlet port using a circular recess portion, a rectangular recess portion may be employed. In this case, if the gasket and the gasket stopper are shaped such that the gasket and the gasket stopper can be fitted into the square recess portion, similar effects can be achieved.

Also, it is not necessary that the portion, which contributes to the press-fitting operation, of the outer circumferential face of the gasket stopper may not be the entire circumference, but a part of the outer circumferential face. Further, the assembly may include a plurality of annular projections formed on the outer circumferential face of the gasket.

What is claimed is:

1. An ink cartridge, comprising:

a cartridge body formed with a first chamber storing ink and a first recessed portion having an ink outlet port from which ink in the first chamber flows out;

an elastic first gasket having a first through hole, the elastic first gasket being fitted into the first recessed portion; and a first gasket stopper having a second through hole, a first face brought into contact with a side inner face of the first recessed portion, and a second face pressing the first gasket such that the first gasket is brought into contact with a bottom inner face of the first recessed portion.

2. The ink cartridge as set forth in claim 1, wherein the bottom inner face of the first recessed portion is provided with an annular projection surrounding the ink outlet port.

3. The ink cartridge as set forth in claim 1, wherein an annular protrusion is formed on an outer circumferential face of the first gasket and brought into contact with the side inner face of the first recessed portion.

4. The ink cartridge as set forth in claim 1, further comprising:

a first valve body, disposed in the first chamber; and a first elastic member, which urges the first valve body toward the first recessed portion such that the first through hole of the first gasket is closed by the first valve body.

5. The ink cartridge as set forth in claim 1, wherein:

the cartridge body is formed with a second chamber storing waste ink and a second recessed portion having an ink inlet port from which the waste ink flows in; and the ink cartridge further comprises:

an elastic second gasket, having a third through hole and fitted into the second recessed portion; and a second gasket stopper, having a fourth through hole, a third face brought into contact with a side inner face of the second recessed portion, and a fourth face pressing the second gasket such that the second gasket is brought into contact with a bottom inner face of the second recessed portion.

6. The ink cartridge as set forth in claim 5, wherein the bottom inner face of the second recessed portion is provided with an annular projection surrounding the ink outlet port.

7. The ink cartridge as set forth in claim 5, wherein the second gasket has a projection adapted to be fitted with the second gasket stopper.

8. The ink cartridge as set forth in claim 5, wherein an annular protrusion is formed on an outer circumferential face of the second gasket and brought into contact with the second side inner face of the second recessed portion.

9. The ink cartridge as set forth in claim 5, further comprising:

a second valve body, disposed in the second chamber; and a second elastic member, which urges the second valve body toward the second recessed portion such that the third through hole of the second gasket is closed by the second valve body.

10. An ink jet printer, comprising:

an ink jet recording head; and a first hollowed needle, having a first hole at a tip end thereof and adapted to be inserted into the ink outlet port of the ink cartridge as set forth in claim 1 while passing through the first through hole and the second through hole and while enlarging the first through hole in order to supply the ink in the first chamber to the ink jet recording head via the first hole.

11. The ink jet printer as set forth in claim 10, wherein:

the cartridge body is formed with a second chamber storing waste ink and a second recessed portion having an ink inlet port from which the waste ink flows in; and ink cartridge further comprises:

an elastic second gasket, having a third through hole and fitted into the second recessed portion; and a second gasket stopper, having a fourth through hole, a third face brought into contact with a side inner face of the second recessed portion, and a fourth face pressing the second gasket such that the second gasket is brought into contact with a bottom inner face of the second recessed portion, the ink jet printer further comprising a second hollowed needle, having a second hole at a tip end thereof and adapted to be inserted into the ink inlet port of the ink cartridge while passing through the third through hole and the fourth through hole and while enlarging the third through hole in order to supply the waste ink to the second chamber via the second hole.

12. An ink cartridge comprising:

a cartridge body formed with a first chamber storm ink and a first recessed portion having an ink outlet port from which ink in the first chamber flows out;

an elastic first gasket having a first through hole, the elastic first gasket being fitted into the first recessed portion; and a first gasket stopper having a second through hole, a first face brought into contact with a side inner face of the first recessed portion, and a second face pressing the first gasket such that the first gasket is brought into contact with a bottom inner face of the first recessed portion, wherein the first gasket has a projection adapted to be fitted with the first gasket stopper.

13. An ink cartridge, comprising:

a cartridge body formed with a first chamber storing ink and a first recessed portion having an ink outlet port from which ink in the first chamber flows out;

an elastic first gasket having a first through hole, the elastic first gasket being fitted into the first recessed portion; and a first gasket stopper having a second through hole and fitted into the first recessed portion such that the first gasket is pressed against an inner face of the first recessed portion, wherein:

the cartridge body is formed with a second chamber storing waste ink and a second recessed portion having an ink inlet port from which the waste ink flows in; and the ink cartridge further comprises:

an elastic second gasket, having a third though hole and fitted into the second recessed portion; and a second gasket stopper, having a fourth through hole and fitted into the second recessed portion such that the second gasket is pressed against an inner face of the second recessed portion.

* * * * *